US012716154B2

(12) United States Patent
Saita et al.

(10) Patent No.: US 12,716,154 B2
(45) Date of Patent: Aug. 25, 2026

(54) SPUN-BONDED NONWOVEN FABRIC AND SANITARY MATERIAL

(71) Applicant: MITSUI CHEMICALS ASAHI LIFE MATERIALS CO., LTD., Tokyo (JP)

(72) Inventors: Shohei Saita, Ichihara (JP); Taiichirou Ichikawa, Tokyo (JP); Hirotaka Kanaya, Chiba (JP)

(73) Assignee: MITSUI CHEMICALS ASAHI LIFE MATERIALS CO., LTD., Tokyo (JP)

( * ) Notice: Subject to any disclaimer, the term of this patent is extended or adjusted under 35 U.S.C. 154(b) by 268 days.

(21) Appl. No.: 18/552,733

(22) PCT Filed: Mar. 18, 2022

(86) PCT No.: PCT/JP2022/012798
§ 371 (c)(1),
(2) Date: Sep. 27, 2023

(87) PCT Pub. No.: WO2022/210047
PCT Pub. Date: Oct. 6, 2022

(65) Prior Publication Data

US 2024/0158966 A1 May 16, 2024

(30) Foreign Application Priority Data

Mar. 30, 2021 (JP) ..... 2021-058789

(51) Int. Cl.
*D04H 3/007* (2012.01)
*D01F 8/06* (2006.01)
(Continued)

(52) U.S. Cl.
CPC ..... *D04H 3/007* (2013.01); *D01F 8/06* (2013.01); *D04H 3/018* (2013.01); *D04H 3/147* (2013.01);
(Continued)

(58) Field of Classification Search
None
See application file for complete search history.

(56) References Cited

U.S. PATENT DOCUMENTS

2011/0092936 A1* 4/2011 Kunimoto ..... D01F 6/04 442/401
2013/0035015 A1 2/2013 Suzuki et al.
(Continued)

FOREIGN PATENT DOCUMENTS

JP 2002146631 * 5/2002
JP 2003519295 A 6/2003
(Continued)

OTHER PUBLICATIONS

Machine Translation of JP2020143411 (Year: 2020).*
Machine Translation of JP2002146631 (Year: 2002).*

*Primary Examiner* — Shawn Mckinnon
(74) *Attorney, Agent, or Firm* — BUCHANAN INGERSOLL & ROONEY PC

(57) ABSTRACT

Provided is a spun-bonded nonwoven fabric including fibers formed of a resin composition that contains: a propylene polymer (A); and a polymer (B) which is at least one selected from the group consisting of polyolefins, other than the propylene polymer (A), and polyesters. The fibers have a sea-island structure. The fibers include fibers in which a ratio of island phases having a diameter of less than 0.32 μm among those island phases at a cross-section perpendicular to the axial direction of the fibers is 60% or higher on a number basis. In the spun-bonded nonwoven fabric, a ratio ($S_{MB}/S_{CB}$) of the tensile strength ($S_{MD}$) in a machine flow direction (MD) with respect to the tensile strength ($S_{CD}$)) in a direction (CD) perpendicular to the machine flow direction (MD) is from 2.0 to 5.1.

11 Claims, 2 Drawing Sheets

(51) Int. Cl.

| | |
|---|---|
| ***D04H 3/018*** | (2012.01) |
| ***D04H 3/147*** | (2012.01) |
| ***D04H 3/16*** | (2006.01) |

(52) U.S. Cl.
CPC ..... *D04H 3/16* (2013.01); *D10B 2321/021* (2013.01); *D10B 2321/022* (2013.01); *D10B 2401/06* (2013.01); *D10B 2509/02* (2013.01)

(56) References Cited

U.S. PATENT DOCUMENTS

| | | | |
|---|---|---|---|
| 2018/0213852 | A1 | 8/2018 | Matsubara et al. |
| 2020/0362492 | A1 | 11/2020 | Ichikawa et al. |

FOREIGN PATENT DOCUMENTS

| | | | | |
|---|---|---|---|---|
| JP | 2020143411 | | * | 9/2020 |
| JP | 2020143411 | A | | 9/2020 |
| WO | 0149905 | A2 | | 7/2001 |
| WO | 2009145105 | A1 | | 12/2009 |
| WO | 2011129433 | A1 | | 10/2011 |
| WO | 2017006972 | A1 | | 1/2017 |

* cited by examiner

SPUN-BONDED NONWOVEN FABRIC AND SANITARY MATERIAL

TECHNICAL FIELD

The present disclosure relates to a spun-bonded nonwoven fabric and a sanitary material.

BACKGROUND ART

In recent years, nonwoven fabrics are widely used in various applications because of their excellent air permeability and flexibility. Representative applications of nonwoven fabrics include: absorbent articles, such as disposable diapers and sanitary napkins; and base fabrics of sanitary masks, medical gauze, and poultices.

Depending on the position of use, such nonwoven fabrics are required to have extensibility and the like from the standpoint of the ease of secondary processing.

Patent Document 1 discloses a spun-bonded nonwoven fabric having favorable low-temperature heat-sealability and stretch processing suitability. The spun-bonded nonwoven fabric disclosed in Patent Document 1 is formed of a specific composition. This specific composition contains a propylene homopolymer having a melting point of 140° C. or higher, a polyethylene, and at least one selected from a first polymer and a second polymer. The first polymer is a random copolymer of propylene and at least one selected from ethylene and α-olefins having from 4 to 20 carbon atoms. The second polymer is a specific propylene homopolymer having a melting point of lower than 120° C. A total content of the first polymer and the second polymer in the composition is in a specific range.

Patent Document 1: WO 2017/006972

SUMMARY OF INVENTION

Technical Problem

The nonwoven fabric disclosed in Patent Document 1 is excellent in low-temperature heat-sealability; however, its extensibility is required to be further improved in some cases. In the use as a nonwoven fabric, an extensible nonwoven fabric required to have extensibility is often subjected to a stretching process for providing flexibility and performing a desired shaping treatment. However, depending on the properties of the nonwoven fabric to be stretched, the stretching process may cause breakage of the nonwoven fabric, making it impossible to perform a desired processing. In other words, the nonwoven fabric to be stretched does not necessarily have a sufficient stretch processing suitability in some cases. In order to provide a spun-bonded nonwoven fabric having an excellent balance of quality and cost, it is demanded to further improve the spinnability of the nonwoven fabric disclosed in Patent Document 1.

In view of the above-described circumstances, an object of the disclosure is to provide: a spun-bonded nonwoven fabric excellent in extensibility and spinnability; and a sanitary material.

Solution to Problem

Means for solving the above-described problems include the following embodiments.

<1> A spun-bonded nonwoven fabric, including fibers formed of a resin composition that contains:

a propylene polymer (A); and a polymer (B) which is at least one selected from the group consisting of polyolefins, other than the propylene polymer (A), and polyesters, wherein:

the fibers have a sea-island structure, the fibers include fibers in which a ratio of island phases having a diameter of less than 0.32 μm among those island phases at a cross-section perpendicular to the axial direction of the fibers is 60% or higher on a number basis, and a ratio ($S_{MD}/S_{CD}$) of the tensile strength ($S_{MD}$) in a machine flow direction (MD) with respect to the tensile strength ($S_{CD}$) in a direction (CD) perpendicular to the machine flow direction (MD) is from 2.0 to 5.1.

<2> The spun-bonded nonwoven fabric according to <1>, wherein the propylene polymer (A) contains a propylene homopolymer.

<3> The spun-bonded nonwoven fabric according to <1> or <2>, wherein the polymer (B) contains a homopolymer of an α-olefin having from 2 to 8 carbon atoms, other than the propylene polymer (A).

<4> The spun-bonded nonwoven fabric according to any one of <1> to <3>, wherein the polymer (B) contains a polyethylene.

<5> The spun-bonded nonwoven fabric according to <4>, wherein the polyethylene has a density of from 0.94 g/cm$^3$ to 0.97 g/cm$^3$.

<6> The spun-bonded nonwoven fabric according to any one of <1> to <5>, wherein:

the sea phase contained in the sea-island structure contains the propylene polymer (A), and the island phases contain the polymer (B).

<7> The spun-bonded nonwoven fabric according to any one of <1> to <6>, wherein the ratio ($S_{MD}/S_{CD}$) is from 2.5 to 5.1.

<8> The spun-bonded nonwoven fabric according to any one of <1> to <7>, wherein a content of the propylene polymer (A) is from 85.0% by mass to 95.0% by mass with respect to a total amount of the resin composition.

<9> The spun-bonded nonwoven fabric according to any one of <1> to <8>, wherein a content of the polymer (B) is from 1.0% by mass to 10.0% by mass with respect to a total amount of the resin composition.

<10> The spun-bonded nonwoven fabric according to any one of <1> to <9>, wherein:

the resin composition contains a low-molecular-weight olefin polymer having a weight-average molecular weight of from 500 to 30,000, and a content of the low-molecular-weight olefin polymer is from 0.1% by mass to 5.0% by mass with respect to a total amount of the resin composition.

<11> The spun-bonded nonwoven fabric according to any one of <1> to <10>, wherein:

the spun-bonded nonwoven fabric includes thermoplastic elastomer fibers and is a layered nonwoven fabric or a mixed-fiber nonwoven fabric, the layered nonwoven fabric includes a spun-bonded web containing the fibers, and a resin layer that is disposed on at least one main surface of the spun-bonded web and contains the thermoplastic elastomer fibers, the spun-bonded web and the resin layer being bonded with each other, and the mixed-fiber nonwoven fabric includes a mixture of the fibers and the thermoplastic elastomer fibers.

<12> The spun-bonded nonwoven fabric according to <11>, wherein the thermoplastic elastomer fibers are polyurethane-based thermoplastic elastomer fibers, or olefin-based thermoplastic elastomer fibers.

<13> A sanitary material, including the spun-bonded nonwoven fabric according to any one of <1> to <12>.

Advantageous Effects of Invention

According to the present invention, a spun-bonded nonwoven fabric excellent in extensibility and spinnability, and a sanitary material are provided.

DESCRIPTION OF EMBODIMENTS

Mode for Carrying Out the Invention

Figure 1:
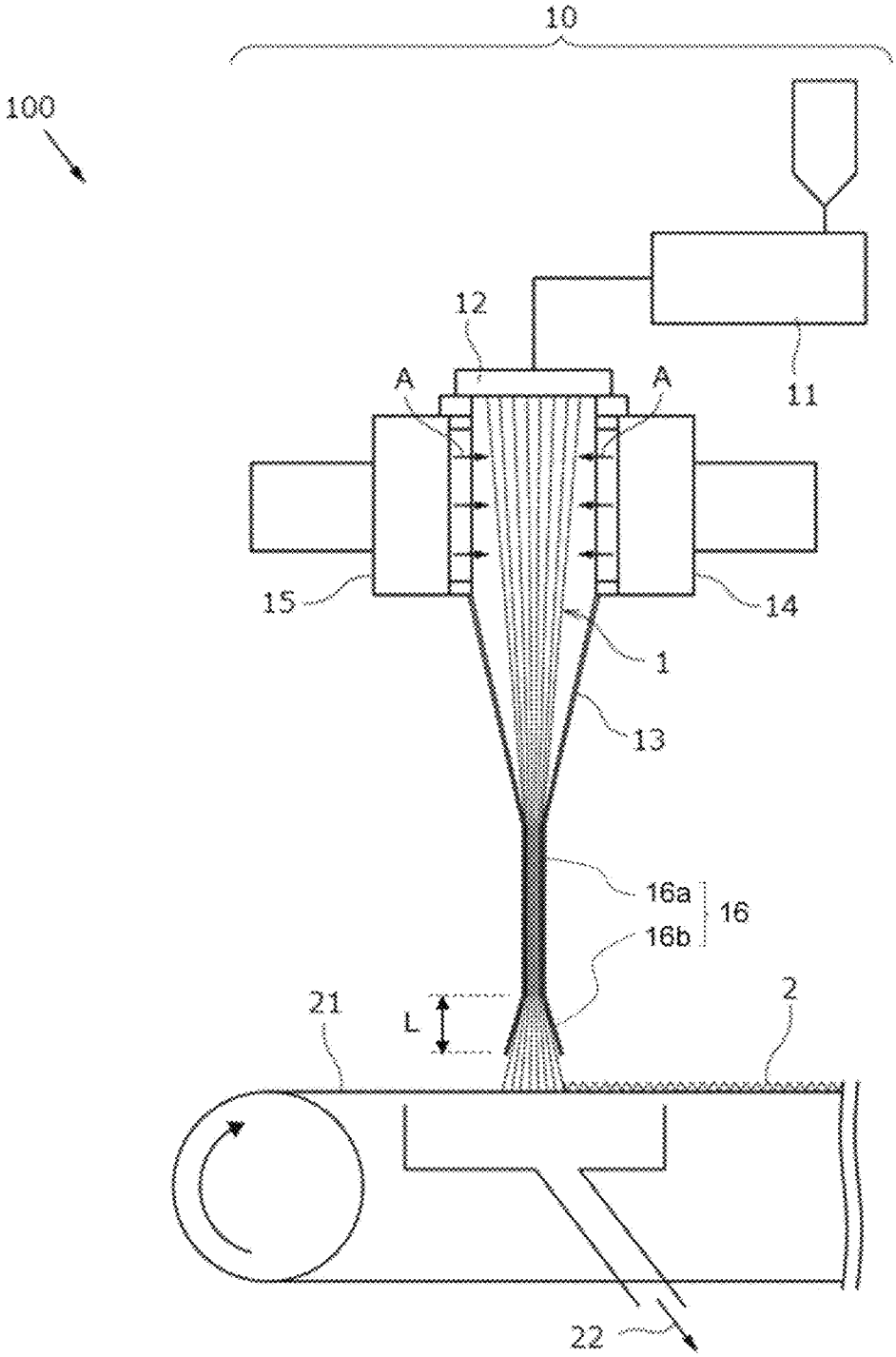
FIG. 1 is a schematic drawing that illustrates one example of a production apparatus used for a closed-system spun-bonding method.

The contents of the invention will now be described in detail. Requirements of the invention may be described below based on a representative embodiment of the invention; however, the disclosure is not limited to such an embodiment.

In the disclosure, the term "step" encompasses not only a discrete step but also a step that cannot be clearly distinguished from other steps, as long as the intended purpose of the step is achieved.

In the disclosure, when there are plural kinds of substances that correspond to a component of a thermoplastic resin composition, an indicated amount of the component in the thermoplastic resin composition means, unless otherwise specified, a total amount of the plural kinds of substances existing in the thermoplastic resin composition.

In the disclosure, those numerical ranges that are expressed with "to" each denote a range that includes the numerical values stated before and after "to" as the lower limit value and the upper limit value, respectively.

In the disclosure, in a set of numerical ranges that are stated in a stepwise manner in the section of "Mode for Carrying Out the Invention", the upper limit value or the lower limit value of one numerical range may be replaced with the upper limit value or the lower limit value of other numerical range. In the disclosure, the upper limit value or the lower limit value of a numerical range stated in the section of "Mode for Carrying Out the Invention" may be replaced with any relevant value indicated in the section of "Examples".

In the disclosure, a combination of two or more preferred aspects is a more preferred aspect.

(1) Spun-Bonded Nonwoven Fabric

The spun-bonded nonwoven fabric of the disclosure includes fibers formed of a resin composition that contains: a propylene polymer (A); and a polymer (B) which is at least one selected from the group consisting of polyolefins, other than the propylene polymer (A), and polyesters, wherein the fibers have a sea-island structure, the fibers include fibers in which a ratio of island phases having a diameter of less than 0.32 μm among island phases at a cross-section perpendicular to an axial direction of the fibers is 60% or higher on a number basis, and a ratio ($S_{MD}/S_{CD}$) of a tensile strength ($S_{MD}$) in a machine flow direction (MD) with respect to a tensile strength ($S_{CD}$) in a direction (CD) perpendicular to the machine flow direction (MD) is from 2.0 to 5.1.

The term "spun-bonded nonwoven fabric" used herein refers to a nonwoven fabric produced by one or more bonding methods in which a continuous fiber (filament) group generated by spinning a molten or dissolved thermoplastic resin composition from a spinneret is disposed on a moving collection member (e.g., a net conveyer).

The term "sea-island structure" used herein refers to a phase-separated structure in which phases (island phases) containing one of at least two components exist (e.g., are dispersed) in a continuous phase (sea phase) formed of the other component.

The expression "fibers have a sea-island structure" used herein means that a cross-sections of the fibers cut in a direction perpendicular to the axial direction of the fibers have a sea-island structure.

The term "machine flow direction (MD)" refers to a direction parallel to the moving direction of a moving collection member.

The term "direction (CD) perpendicular to the machine flow direction (MD)" refers to a direction perpendicular to the moving direction of a moving collection member in the plane direction of the moving collection member.

Hereinafter, "fibers having a sea-island structure" may be referred to as "sea-island fibers".

Hereinafter, a "ratio of island phases having a diameter of less than 0.32 μm among island phases at a cross-section perpendicular to an axial direction of the fibers" may be simply referred to as "island phase ratio".

Hereinafter, "machine flow direction (MD)" and "direction (CD) perpendicular to the machine flow direction (MD)" are referred to as "machine direction (MD)" and "cross direction (CD)", respectively.

Hereinafter, a "ratio ($S_{MD}/S_{CD}$) of a tensile strength ($S_{MD}$) in a machine flow direction (MD) with respect to a tensile strength ($S_{CD}$) in a direction (CD) perpendicular to the machine flow direction (MD)" may be referred to as "tensile strength ratio ($S_{MD}/S_{CD}$)".

The spun-bonded nonwoven fabric of the disclosure has the above-described constitution and is thus excellent in extensibility and spinnability.

The expression "excellent in extensibility" used herein means that the spun-bonded nonwoven fabric has a first property and a second property. The "first property" refers to a property that, when an external force is applied to the spun-bonded nonwoven fabric, the outer shape of the spun-bonded nonwoven fabric extends in one direction. The "second property" refers to a property that, even when the external force applied to the spun-bonded nonwoven fabric is removed, an original outer shape of the spun-bonded nonwoven fabric is hardly restored. A method of quantitatively evaluating the extensibility of the spun-bonded nonwoven fabric is the same as the evaluation method described below in the section of Examples.

The expression "excellent in spinnability" used herein means that, when a thermoplastic resin composition used as a raw material of the spun-bonded nonwoven fabric is discharged from a spinneret and during stretching of the resulting continuous fiber group, fiber breakage is unlikely to occur and fusion of continuous fibers does not occur. A method of quantitatively evaluating the spinnability of the spun-bonded nonwoven fabric is the same as the evaluation method described below in the section of Examples.

The reason why the spun-bonded nonwoven fabric of the disclosure is excellent in extensibility and spinnability is not clear; however, it is presumed as follows.

When the island phase ratio of the fibers contained in the spun-bonded nonwoven fabric is in the above-described range, oriented crystallization of the propylene polymer (A) is uniformly inhibited inside the sea-island fibers. By this, the extensibility and the spinnability of the spun-bonded nonwoven fabric are improved.

Further, when the tensile strength ratio ($S_{MD}/S_{CD}$) of the spun-bonded nonwoven fabric is in the above-described range, the dispersion direction of the fibers constituting the spun-bonded nonwoven fabric is likely to be parallel to the machine direction (MD). By this, the resulting spun-bonded nonwoven fabric is provided with excellent extensibility.

A synergistic effect attributed to a combination of these features is presumed to be the main factor as to why the spun-bonded nonwoven fabric of the disclosure is excellent in extensibility and spinnability.

(1.1) Tensile Strength Ratio ($S_{MD}/S_{CD}$)

The spun-bonded nonwoven fabric of the disclosure has a tensile strength ratio ($S_{MD}/S_{CD}$) of from 2.0 to 5.1. Since the tensile strength ratio ($S_{MD}/S_{CD}$) is from 2.0 to 5.1, a greater amount of the fibers are oriented in a direction perpendicular to the machine direction (MD) than in the cross direction (CD). In addition, the spun-bonded nonwoven fabric has superior extensibility in the machine direction (MD). Since the tensile strength ratio ($S_{MD}/S_{CD}$) is 5.0 or lower, the tensile strength of the spun-bonded nonwoven fabric is not excessively high, so that breakage of the fibers constituting the spun-bonded nonwoven fabric is inhibited.

From the standpoint of improving the extensibility of the spun-bonded nonwoven fabric, the tensile strength ratio ($S_{MD}/S_{CD}$) may be, for example, from 2.0 to 5.0, and it is preferably from 2.5 to 5.1, more preferably from 2.5 to 5.1, still more preferably from 3.0 to 5.0, particularly preferably from 3.5 to 5.0.

The tensile strength ratio ($S_{MD}/S_{CD}$) of the spun-bonded nonwoven fabric can be determined in accordance with JIS L1906-6.12.1 [Method A] (changed to JIS L1913:2010, corresponding to ISO 9073-3:1989), as described below in detail in the section of Examples.

The machine direction (MD) of the spun-bonded nonwoven fabric can be determined from the spun-bonded nonwoven fabric itself by measuring its tensile strength.

Generally, in the production of a spun-bonded nonwoven fabric, the moving speed of a moving collection member is set rather fast from the standpoint of productivity. Thus, a continuous fiber group is likely to be oriented in a direction parallel to the machine direction (MD) at the time of being disposed on the moving collection member. Consequently, the resulting spun-bonded nonwoven fabric has a higher tensile strength in the machine direction (MD) than in the cross direction (CD). Therefore, the machine direction (MD) of the spun-bonded nonwoven fabric can be determined from the spun-bonded nonwoven fabric itself by measuring its tensile strength.

(1.2) Fibers Having Sea-Island Structure

The spun-bonded nonwoven fabric includes sea-island fibers.

The sea-island fibers are formed of a resin composition that contains: a propylene polymer (A); and a polymer (B) which is at least one selected from the group consisting of polyolefins, other than the propylene polymer (A), and polyesters.

Hereinafter, the propylene polymer (A) may be referred to as "specific polypropylene (A)".

Hereinafter, the polymer (B) which is at least one selected from the group consisting of polyolefins, other than the propylene polymer (A), and polyesters may be referred to as "specific polymer (B)".

The sea-island structure has a sea phase and plural island phases. The plural island phases exist (e.g., are dispersed) in the sea phase.

The sea phase preferably contains the specific polypropylene (A), and the plural island phases preferably each contain the specific polymer (B). By this, oriented crystallization of the sea phase as a main component is inhibited, allowing the spun-bonded nonwoven fabric to exert extensibility.

The sea-island fibers have a fiber diameter of preferably 4.0 d (denier) or less, more preferably 3.5 d or less, still more preferably 3.0 d or less.

The sea-island fibers may be long fibers (filaments) or short fibers (staples). A cross-sectional shape of the sea-island fibers is not particularly limited, and examples thereof include a circular shape, an elliptical shape, and an irregular shape.

(1.2.1) Island Phase Ratio

The sea-island fibers have an island phase ratio of 60% or higher on a number basis. Since the island phase ratio is 60% or higher on a number basis, heterogeneous inhibition of oriented crystallization of the specific polypropylene (A) is unlikely to occur inside the fibers. This makes the spun-bonded nonwoven fabric excellent in extensibility and spinnability.

From the standpoint of improving the extensibility of the spun-bonded nonwoven fabric, the island phase ratio is preferably 70% or higher, more preferably 80% or higher, still more preferably 90% or higher, on a number basis.

A method of controlling the island phase ratio of the sea-island fibers at 60% or higher on a number basis is not particularly limited, and examples thereof include a raw material adjustment method and a production equipment adjustment method.

In the raw material adjustment method, the raw materials of the sea-island fibers are adjusted. Specifically, the island phase ratio can be controlled at 60% or higher on a number basis by incorporating the below-described low-molecular-weight olefin polymer into the sea-island fibers.

In the production equipment adjustment method, equipment used for the production of the spun-bonded nonwoven fabric is adjusted. Specific examples of the production equipment adjustment method include a method of selecting a screw that has a shape with improved kneading performance, a method of increasing the resin pressure in a die, and a method of increasing the die outlet temperature. The island phase ratio can be controlled at 60% or higher on a number basis by any of these methods.

A lower limit of the ratio of island phase area (hereinafter, referred to as "island phase area ratio") with respect to a total area of a cross-section of the sea-island fibers is preferably 1.0% or higher. When the lower limit of the island phase area ratio is 1.0% or higher, oriented crystallization of the specific polypropylene (A) is likely to be inhibited inside the sea-island fibers.

An upper limit of the island phase area ratio is preferably 20% or lower. When the upper limit of the island phase area ratio is 20% or lower, heterogeneous inhibition of oriented crystallization of the specific polypropylene (A) is unlikely to occur inside the sea-island fibers, so that the spun-bonded nonwoven fabric exhibits superior extensibility and spinnability.

A method of adjusting the island phase area ratio is not particularly limited, and examples thereof include a raw material adjustment method.

(1.2.2) Material of Fibers Having Sea-Island Structure

The sea-island fibers contained in the spun-bonded nonwoven fabric are formed of a resin composition. Inclusion of the above-described components in the resin composition can be confirmed as appropriate by any known method.

(1.2.2.1) Specific Polypropylene (A)

The resin composition of the sea-island fibers contains a specific polypropylene (A). The specific polypropylene (A) may be used singly, or in combination of two or more kinds that are different from each other in melting point, molecular weight, crystal structure, and the like.

The specific polypropylene (A) contains a structural unit derived from propylene.

The specific polypropylene (A) is a propylene homopolymer or a propylene copolymer. The propylene copolymer is preferably a copolymer of propylene and a small amount of one or more kinds of α-olefins.

The number of carbon atoms of the α-olefins in the propylene copolymer is 2 or more, other than 3, preferably from 2 to 8, other than 3. Specific examples of the α-olefins in the propylene copolymer include ethylene, 1-butene, 1-pentene, 1-hexene, 1-octene, and 4-methyl-1-pentene.

Thereamong, the specific polypropylene (A) preferably contains a propylene homopolymer, more preferably is a propylene homopolymer.

The specific polypropylene (A) has a melting point of preferably 140° C. or higher, more preferably 150° C. or higher, still more preferably 155° C. or higher, particularly preferably from 157° C. to 165° C.

The melting point of the specific polypropylene (A) is defined as the top of a peak observed on the highest temperature side of a melting endothermic curve that is obtained by using a differential scanning calorimeter (DSC) in which the specific polypropylene (A) is maintained at −40° C. for 5 minutes in a nitrogen atmosphere and the temperature is subsequently raised at a rate of 10° C./min.

Specifically, the melting point can be determined as the top of a peak observed on the highest temperature side of a melting endothermic curve that is obtained by using a differential scanning calorimeter (manufactured by PerkinElmer Co., Ltd., product name: DSC-7) in which 5 mg of a sample is maintained at −40° C. for 5 minutes in a nitrogen atmosphere and the temperature is subsequently raised at a rate of 10° C./min.

The melt flow rate (MFR) of the specific polypropylene (A) is not particularly limited as long as the thermoplastic resin composition, which is a raw material of the spun-bonded nonwoven fabric, can be melt-spun, and the melt flow rate is preferably from 1 g/10 min to 1,000 g/10 min, more preferably from 5 g/10 min to 500 g/10 min, still more preferably from 10 g/10 min to 100 g/10 min.

The melt flow rate of the specific polypropylene (A) is measured by a method conforming to the ASTM standard D-1238. As for the measurement conditions, the melt flow rate of the specific polypropylene (A) is measured at 230° C. with a load of 2.16 kg.

A content of the specific polypropylene (A) is preferably from 55.0% by mass to 95.0% by mass, more preferably from 65.0% by mass to 95.0% by mass, still more preferably from 75.0% by mass to 95.0% by mass, particularly preferably from 85.0% by mass to 95.0% by mass, with respect to a total amount of the resin composition.

When the content of the specific polypropylene (A) is in this range, not only the extensibility of the spun-bonded nonwoven fabric is improved and the tensile strength of the spun-bonded nonwoven fabric is maintained in a favorable range, but also the spun-bonded nonwoven fabric has a low basis weight and is flexible. Particularly, when the content of the specific polypropylene (A) is from 85.0% by mass to 95.0% by mass, excessive aggregation of the island phases is inhibited, so that the spun-bonded nonwoven fabric can achieve both satisfactory extensibility and satisfactory spinnability. When the content of the specific polypropylene (A) is in the above-described range, the specific polypropylene (A) is contained in the sea phase, while the specific polymer (B) is contained in the island phases.

As the specific polypropylene (A) of the disclosure, any commercially available product may be used as long as it satisfies the above-described conditions.

(1.2.2.2) Specific Polymer (B)

The sea-island fibers contains a specific polymer (B). The specific polymer (B) may be used singly, or in combination of two or more kinds that are different from each other in melting point, molecular weight, crystal structure, and the like.

The specific polymer (B) is at least one selected from the group consisting of polyolefins, other than the propylene polymer (A), and polyesters.

The polyolefins, other than the propylene polymer (A), are homo- or co-polymers of α-olefins. The α-olefins are α-olefins having 2 or more carbon atoms, other than those having 3 carbon atoms, and preferably contain homopolymers of α-olefins having from 2 to 8 carbon atoms, other than those having 3 carbon atoms, more preferably are homopolymers of α-olefins having from 2 to 8 carbon atoms, other than those having 3 carbon atoms. Specific examples of such α-olefins include ethylene, 1-butene, 1-pentene, 1-hexene, 1-octene, and 4-methyl-1-pentene, among which ethylene is preferred.

Specific examples of the polyolefins, other than the propylene polymer (A), include polyethylenes (ethylene homopolymers), ethylene-α-olefin copolymers, propylene polymers, 1-butene polymers, and poly-4-methyl-1-pentene.

Examples of the polyethylenes include high-pressure low-density polyethylenes, linear low-density polyethylenes (LLDPE), and high-density polyethylenes (HDPE).

Examples of the ethylene-α-olefin copolymers include ethylene-propylene random copolymers and ethylene-1-butene random copolymers.

Examples of the propylene polymers include propylene-ethylene random copolymers, propylene-ethylene-1-butene random copolymers, propylene block copolymers, and propylene-1-butene random copolymers.

Examples of the 1-butene polymers include 1-butene homopolymers, 1-butene-ethylene copolymers, and 1-butene-propylene copolymers.

The polyesters are, for example, aliphatic polyesters or polyester copolymers. Examples of the polyester copolymers include those obtained by polymerizing one or more kinds of diols with an aliphatic dicarboxylic acid alone, or a mixture of an aliphatic dicarboxylic acid and an aromatic dicarboxylic acid.

Thereamong, the specific polymer (B) preferably contains a polyethylene, more preferably is a polyethylene.

From the standpoint of improving the tensile strength of the spun-bonded nonwoven fabric as well as from the standpoint of the extensibility and the flexibility of the spun-bonded nonwoven fabric, the polyethylene has a density of preferably from 0.94 g/cm$^3$ to 0.98 g/cm$^3$, more preferably from 0.94 g/cm$^3$ to 0.97 g/cm$^3$.

The specific polymer (B) has a melting point of preferably 150° C. or higher, more preferably 155° C. or higher, still more preferably from 155° C. to 165° C.

The melt flow rate of the specific polymer (B) is not particularly limited as long as a melt of the thermoplastic resin composition, which is a raw material of the spun-bonded nonwoven fabric, can be spun, and the melt flow rate is preferably from 1 g/10 min to 1,000 g/10 min, more preferably from 2 g/10 min to 500 g/10 min, still more preferably from 3 g/10 min to 100 g/10 min.

When the specific polymer (B) is a polyethylene, the melt flow rate thereof is measured by a method conforming to the ASTM standard D-1238. As for the measurement conditions, the melt flow rate of the polyethylene is measured at 190° C. with a load of 2.16 kg.

A content of the specific polymer (B) is preferably from 1.0% by mass to 10.0% by mass, more preferably from 3.0% by mass to 8.0% by mass, still more preferably from 5.0% by mass to 7.0% by mass, with respect to a total amount of the resin composition. As long as the content of the specific polymer (B) is in this range, the extensibility of the spun-bonded nonwoven fabric is improved.

(1.2.2.3) Low-Molecular-Weight Olefin Polymer

The resin composition contains a low-molecular-weight olefin polymer having a weight-average molecular weight of from 500 to 30,000, and a content of the low-molecular-weight olefin polymer is preferably from 0.1% by mass to 5.0% by mass with respect to a total amount of the resin composition. The low-molecular-weight olefin polymer may be used singly, or in combination of two or more kinds that are different from each other in melting point, molecular weight, crystal structure, and the like.

As long as the sea-island fibers contain a low-molecular-weight olefin polymer and the content of the low-molecular-weight olefin polymer is in the above-described range, the dispersibility of the specific polypropylene (A) and the specific polymer (B) is improved. As a result, the extensibility and the spinnability of the spun-bonded nonwoven fabric are further improved.

When the sea-island fibers contain a low-molecular-weight olefin polymer, the content of the low-molecular-weight olefin polymer is preferably from 0.1% by mass to 5.0% by mass with respect to a total amount of the resin composition.

From the standpoint of allowing a sufficient amount of the low-molecular-weight olefin polymer to exist at the interfaces between the sea phase and the island phases so as to improve the dispersibility of the specific polypropylene (A) and the specific polymer (B), a lower limit of the content of the low-molecular-weight olefin polymer is more preferably not less than 0.2% by mass, still more preferably not less than 1.0% by mass, particularly preferably not less than 1.5% by mass, with respect to a total amount of the resin composition.

From the standpoint of preventing a marked reduction in the strength of the sea-island fibers, an upper limit of the content of the low-molecular-weight olefin polymer is more preferably 4.0% by mass or less, still more preferably 3.0% by mass or less, particularly preferably 2.5% by mass or less, with respect to a total amount of the resin composition.

The low-molecular-weight olefin polymer may contain a single kind of olefin-derived structural unit, or may contain two or more kinds of olefin-derived structural units.

The low-molecular-weight olefin polymer is a wax-like polymer. In other words, the weight-average molecular weight (Mw) of the low-molecular-weight olefin polymer is less than those of the specific polypropylene (A) and a poly-α-olefin.

The weight-average molecular weight (Mw) of the low-molecular-weight olefin polymer is from 500 to 30,000.

As long as the weight-average molecular weight (Mw) of the low-molecular-weight olefin polymer is in this range, the dispersibility of the specific polypropylene (A) and the specific polymer (B) is further improved. As a result, the spun-bonded nonwoven fabric exhibits superior extensibility and spinnability.

An upper limit of the weight-average molecular weight (Mw) of the low-molecular-weight olefin polymer is 30,000 or less, preferably less than 15,000, more preferably 10,000 or less, still more preferably 6,000 or less, particularly preferably less than 6,000, further preferably 5,000 or less, still further preferably 3,000 or less, yet still further preferably 2,000 or less, further more preferably 1,500 or less.

A lower limit of the weight-average molecular weight (Mw) of the low-molecular-weight olefin polymer is not less than 500, preferably not less than 700, more preferably not less than 1,000.

For the measurement of the weight-average molecular weight (Mw) of the low-molecular-weight olefin polymer, gel permeation chromatography (GPC) may be employed. The GPC measurement conditions are preferably the below-described first measurement conditions. The weight-average molecular weight (Mw) of the low-molecular-weight olefin polymer is determined, for example, based on the below-described conversion method using a calibration curve prepared using a commercially available monodisperse standard polystyrene.

[First Measurement Conditions]

Apparatus: gel permeation chromatograph ALLIANCE GPC 2000 (manufactured by Waters Corporation)

Solvent: o-dichlorobenzene

Columns: TSKgel GMH6-HT×2 (manufactured by Tosoh Corporation) and TSKgel GMH6-HTL column×2 (manufactured by Tosoh Corporation)

Flow rate: 1.0 ml/min

Sample: 0.15 mg/mL o-dichlorobenzene solution

Temperature: 140° C.

Molecular weight conversion: polyethylene (PE) conversion/general calibration method For the calculation of general calibration, the following coefficients of the Mark-Houwink viscosity equation were used.

Coefficient of polystyrene (PS): $KPS=1.38\times10^{-4}$, $aPS=0.70$

Coefficient of polyethylene (PE): $KPE=5.06\times10^{-4}$, $aPE=0.70$

The low-molecular-weight olefin polymer has a softening point of preferably from 90° C. to 145° C., more preferably from 90° C. to 135° C., still more preferably from 100° C. to 125° C.

The softening point of the low-molecular-weight olefin polymer is measured in accordance with JIS K2207.

The density of the low-molecular-weight olefin polymer is not particularly limited, and it is preferably from 0.890 g/cm$^3$ to 0.980 g/cm$^3$.

As long as the density of the low-molecular-weight olefin polymer is in this range, the spun-bonded nonwoven fabric exhibits superior extensibility.

A lower limit of the density of the low-molecular-weight olefin polymer is more preferably not less than 0.910 g/cm$^3$, still more preferably not less than 0.920 g/cm$^3$.

An upper limit of the density of the low-molecular-weight olefin polymer is more preferably 0.960 g/cm$^3$ or less, still more preferably 0.940 g/cm$^3$ or less.

The density of the low-molecular-weight olefin polymer is measured in accordance with JIS K7112.

A difference between the density of the low-molecular-weight olefin polymer and that of the specific polypropylene (A) is not particularly limited, and it is preferably less than 0.35 g/cm$^3$, more preferably less than 0.20 g/cm$^3$, still more preferably less than 0.15 g/cm$^3$.

As long as the difference between the density of the low-molecular-weight olefin polymer and that of the specific polypropylene (A) is in this range, the spun-bonded nonwoven fabric exhibits superior extensibility.

The reason for this is not clear; however, it is believed as follows. It is believed that, when the density of the low-molecular-weight olefin polymer and that of the specific polypropylene (A) are in the above-described respective ranges, for example, the specific polymer (B) are readily dispersed in the specific polypropylene (A) through the low-molecular-weight olefin polymer. In other words, the low-molecular-weight olefin polymer effectively acts as a compatibilizer of the specific polypropylene (A) and the specific polymer (B). Thus, the dispersibility of the specific polypropylene (A) and the specific polymer (B) is improved. It is believed that, as a result, the extensibility of the spun-bonded nonwoven fabric is improved.

The low-molecular-weight olefin polymer is an olefin homopolymer, or an olefin copolymer formed of two or more kinds of olefins.

Particularly, the low-molecular-weight olefin polymer may be an ethylene homopolymer, or a copolymer of ethylene and an α-olefin having from 3 to 20 carbon atoms.

The number of carbon atoms of the α-olefin is preferably from 3 to 8, more preferably from 3 to 4.

As long as the number of carbon atoms of the α-olefin is in this range, the extensibility and the spinnability of the spun-bonded nonwoven fabric are further improved. The reason for this is not clear; however, it is believed as follows.

It is believed that, when the number of carbon atoms of the α-olefin is in the above-described range, for example, the specific polymer (B) is readily dispersed in the specific polypropylene (A) through the low-molecular-weight olefin polymer. In other words, the low-molecular-weight olefin polymer acts as a compatibilizer of the specific polypropylene (A) and a poly-α-olefin. Thus, the uniformity of the specific polypropylene (A) and the specific polymer (B) is improved. It is believed that, as a result, the properties of the spun-bonded nonwoven fabric, such as elongation, are improved.

The low-molecular-weight olefin polymer may be used singly, or in combination of two or more kinds thereof as a mixture.

A method of producing the low-molecular-weight olefin polymer is not particularly limited, and examples thereof include a first production method and a second production method. The first production method refers to a production method based on polymerization of a commonly used low-molecular-weight polymer. The second production method refers to a method of reducing the molecular weight of a high-molecular-weight ethylene polymer by thermal degradation.

The resulting low-molecular-weight olefin polymer may be purified by, for example, a solvent fractionation method of performing fractionation based on a difference in solubility in a solvent, or a distillation method.

Examples of the first production method include production methods using a Ziegler-Natta catalyst, a metallocene catalyst, or the like. Examples of a production method using a metallocene catalyst or the like include the production methods disclosed in JP-A No. H08-239414, WO 2007/114102, and the like.

The low-molecular-weight olefin polymer may be a commercially available product. Examples thereof include "Hi-WAX (registered trademark) 320P", "EXCEREX (registered trademark) 30200B", "Hi-WAX (registered trademark) 100P", and "Hi-WAX (registered trademark) 110P", which are manufactured by Mitsui Chemicals, Inc.

(1.2.2.4) Fatty Acid Amide

The sea-island fibers contain a fatty acid amide having from 15 to 22 carbon atoms, and a content of the fatty acid amide is preferably from 0.1% by mass to 5.0% by mass with respect to a total amount of the resin composition. The fatty acid amide may be used singly, or in combination of two or more kinds thereof.

By this, the fatty acid amide having from 15 to 22 carbon atoms adsorbs to the fiber surfaces of the spun-bonded nonwoven fabric, and the surfaces of the sea-island fibers are modified. In other words, the flexibility, the texture, the blocking resistance, and the like of the spun-bonded nonwoven fabric are further improved. Accordingly, adhesion of the nonwoven fabric fibers to various members such as rotating equipment in an apparatus used for an embossing process or the like is believed to be inhibited more effectively. As a result, the extensibility and the flexibility of the spun-bonded nonwoven fabric are further improved.

The term "number of carbon atoms of the fatty acid amide" used herein means the number of carbon atoms contained in a molecule, and the carbon atom of —CONH constituting an amide is also included in the number of carbon atoms.

The number of carbon atoms of the fatty acid amide is preferably from 18 to 22.

Examples of the fatty acid amide having from 15 to 22 carbon atoms include fatty acid monoamide compounds, fatty acid diamide compounds, saturated fatty acid monoamide compounds, and unsaturated fatty acid diamide compounds, among which palmitic acid amide (number of carbon atoms: 16), stearic acid amide (number of carbon atoms: 18), oleic acid amide (number of carbon atoms: 18), erucic acid amide (number of carbon atoms: 22), and the like are preferred.

The content of the fatty acid amide having from 15 to 22 carbon atoms is preferably from 0.1% by mass to 5.0% by mass, more preferably from 0.1% by mass to 3.0% by mass, still more preferably from 0.1% by mass to 1.0% by mass, with respect to a total amount of the resin composition.

(1.2.2.6) Additives

The sea-island fibers may also contain additives as optional components within a range that does not hinder the object of the disclosure. Examples of the additives include antioxidants, heat stabilizers, weathering stabilizers, antistatic agents, slip agents, hydrophilic agents, antifogging agents, lubricants, dyes, pigments, natural oils, synthetic oils, waxes, and fatty acid amides.

(1.3) Constitution of Spun-Bonded Nonwoven Fabric

The spun-bonded nonwoven fabric may consist of only the sea-island fibers, or may be constituted by the sea-island fibers and fibers that do not have a sea-island structure.

When the spun-bonded nonwoven fabric is constituted by the sea-island fibers and fibers that do not have a sea-island structure, from the standpoint of allowing the spun-bonded nonwoven fabric to exert the above-described effects, a content of the sea-island fibers is preferably from 5% by mass to 95% by mass, more preferably from 15% by mass to 90% by mass, still more preferably from 30% by mass to 85% by mass, particularly preferably from 40% by mass to 70% by mass, with respect to a total amount of the spun-bonded nonwoven fabric.

When the spun-bonded nonwoven fabric consists of only the sea-island fibers, from the standpoint of obtaining both satisfactory flexibility and satisfactory tensile strength in the spun-bonded nonwoven fabric, the basis weight of the spun-bonded nonwoven fabric is preferably 30 g/m$^2$ or less, more preferably 28 g/m$^2$ or less, still more preferably 25 g/m$^2$ or less, particularly preferably from 5 g/m$^2$ to 20 g/m$^2$.

When the spun-bonded nonwoven fabric is applied to the below-described sanitary material or the like, the basis weight of the spun-bonded nonwoven fabric is preferably in a range of from 5 g/m$^2$ to 19 g/m$^2$.

The spun-bonded nonwoven fabric may include stretchable spun-bonded fibers as well.

The stretchable spun-bonded fibers are preferably fibers produced by a spunbonding method in which a resin containing a specific thermoplastic polyurethane elastomer is extrusion-molded. The specific thermoplastic polyurethane elastomer has a solidification start temperature of at least 65° C. as measured by a differential scanning calorimeter (DSC), and the number of particles of a component insoluble in a polar solvent, which is measured by a particle size distribution analyzer equipped with a 100-μm aperture based on a pore electrical resistance method, is 3,000,000/g or less.

The stretchable spun-bonded fibers having the above-described properties can be produced by, for example, the method disclosed in WO 2004/065680 or WO 2011/129433.

When the spun-bonded nonwoven fabric includes such stretchable spun-bonded fibers, the spun-bonded nonwoven fabric may be the below-described layered nonwoven fabric or the below-described mixed-fiber nonwoven fabric.

The spun-bonded nonwoven fabric, depending on the purpose thereof, may be a layered nonwoven fabric or a mixed-fiber nonwoven fabric.

(1.3.1) Layered Nonwoven Fabric

The layered nonwoven fabric includes a spun-bonded web and a resin layer that are bonded with each other. The resin layer is disposed on at least one surface of the spun-bonded web. The spun-bonded web contains sea-island fibers. As a method of bonding the spun-bonded web and the resin layer, any known bonding method may be employed.

The term "spun-bonded web" used herein refers to a web produced by extruding a molten or dissolved thermoplastic resin composition through a spinneret and disposing the resulting continuous fibers (filaments) on a moving collection member (e.g., a net conveyer). The spun-bonded web is different from a spun-bonded nonwoven fabric in that the fibers constituting the spun-bonded web are not bonded with each other.

A layer configuration of the layered nonwoven fabric is not particularly limited as long as the layered nonwoven fabric has one layer of each of the spun-bonded web and the resin layer. In the layered nonwoven fabric, the spun-bonded web may be provided as a single layer, or two or more layers. In the layered nonwoven fabric, the resin layer may be provided as a single layer, or two or more layers.

From the standpoint of obtaining both satisfactory flexibility and satisfactory tensile strength in the layered nonwoven fabric, the basis weight of the layered nonwoven fabric is preferably 100 g/m$^2$ or less, more preferably 90 g/m$^2$ or less, still more preferably 80 g/m$^2$ or less.

When the layered nonwoven fabric is applied to the below-described sanitary material or the like, the basis weight of the layered nonwoven fabric is preferably in a range of from 20 g/m$^2$ to 70 g/m$^2$.

A raw material of the resin layer may be any material as long as it is different from the thermoplastic resin composition used as a raw material of the sea-island fibers.

The resin layer is, for example, a knitted fabric, a woven fabric, a web, a nonwoven fabric, or a film.

Examples of the nonwoven fabric that is one example of the resin layer include spun-bonded nonwoven fabrics, melt-blown nonwoven fabrics, wet-laid nonwoven fabrics, dry-laid nonwoven fabrics, dry pulp nonwoven fabrics, flash-spun nonwoven fabrics, and split-fiber nonwoven fabrics.

These nonwoven fabrics may each be a stretchable nonwoven fabric or a non-stretchable nonwoven fabric. The stretchable nonwoven fabric has a third property and a fourth property. The "third property" refers to a property that, when an external force is applied to the nonwoven fabric, the outer shape of the nonwoven fabric extends in one direction. The "fourth property" refers to a property that, when the external force applied to the nonwoven fabric is removed, an original outer shape of the nonwoven fabric is restored.

Examples of such a stretchable nonwoven fabric include the elastic nonwoven fabric disclosed in WO 2012/070518 in which a low-crystalline polypropylene is used.

Examples of the web that is another example of the resin layer include spun-bonded webs, melt-blown webs, wet-laid webs, dry-laid webs, dry pulp webs, flash-spun webs, and split-fiber webs.

These webs may each be a stretchable web or a non-stretchable web.

When the layered nonwoven fabric is required to have an air permeability, the film that is yet another example of the resin layer is preferably an air-permeable film or a moisture-permeable film.

The air-permeable film is, for example, a film or a porous film, which is formed of a thermoplastic elastomer. Examples of the thermoplastic elastomer used as a raw material of the film include polyurethane-based elastomers, polyester-based elastomers, and polyamide-based elastomers, which have a moisture permeability.

The porous film is obtained by stretching and porosifying a film formed of a thermoplastic resin containing inorganic or organic fine particles. The thermoplastic resin used as a raw material of the porous film is preferably a polyolefin, such as a high-pressure low-density polyethylene, a linear low-density polyethylene (so-called LLDPE), a high-density polyethylene, a polypropylene, a polypropylene random copolymer, or a combination thereof.

When the layered nonwoven fabric is not required to have an air permeability, as a raw material of the film that is yet another example of the resin layer, one or more thermoplastic resins selected from polyethylenes, polypropylenes, and the like can be used.

It is preferred that the layered nonwoven fabric is partially heat-fused.

Examples of a heat fusion method employed for partially heat-fusing the layered nonwoven fabric include the use of a means such as ultrasonic waves, thermal embossing using an embossing roll, and hot air through. Thereamong, the heat fusion method is preferably thermal embossing since it efficiently stretches long fibers at the time of stretching the layered nonwoven fabric.

When the layered nonwoven fabric is partially heat-fused by thermal embossing, usually, the embossed area ratio is preferably from 5% to 30%, more preferably from 5% to 20%. Examples of an embossed shape include a circular shape, an elliptical shape, an oval shape, a square shape, a rhombic shape, a rectangular shape, a quadrangular shape, and a continuous shape based on the aforementioned shapes.

The embossing temperature in the thermal embossing is adjusted as appropriate in accordance with the line speed, the crimping pressure, and the like during the thermal embossing, and it is preferably from 85° C. to 150° C.

When the resin layer is a knitted fabric, a woven fabric, a web, or a nonwoven fabric, the resin layer preferably contains thermoplastic elastomer fibers.

By incorporating thermoplastic elastomer fibers into the resin layer, a stretchable nonwoven fabric in which blocking does not occur can be produced.

A material of the thermoplastic elastomer fibers is not particularly limited as long as it is a thermoplastic elastomer. The thermoplastic elastomer has a soft segment (soft phase) and a hard segment (hard phase). The soft segment (soft phase) has an elasticity in the molecule. The hard segment (hard phase) has a property of inhibiting plastic deformation.

Examples of the thermoplastic elastomer fibers include polyurethane-based thermoplastic elastomer fibers, olefin-based thermoplastic elastomer fibers, styrene-based thermoplastic elastomer fibers, polyester-based thermoplastic elastomer fibers, and polyamide-based thermoplastic elastomer fibers. Thereamong, from the standpoint of the stretchability and the spinning stability of the layered nonwoven fabric, the thermoplastic elastomer fibers are preferably thermoplastic polyurethane fibers or olefin-based thermoplastic elastomer fibers.

Examples of a material of the polyurethane-based thermoplastic elastomer fibers include polyurethanes produced by, for example:

(1) a method of reacting an isocyanate-terminated prepolymer, which is obtained in advance by a reaction between a polyol and an isocyanate compound, with a chain extender; or (2) a method of mixing a polyol and a chain extender in advance, and subsequently reacting the resulting mixture with an isocyanate compound.

Examples of the polyol that is one of the components constituting the polyurethane-based thermoplastic elastomer include polyoxyalkylene polyols, polytetramethylene ether glycols, polyester polyols, polycaprolactone polyols, and polycarbonate diols.

Examples of the isocyanate compound include aromatic, aliphatic, or alicyclic compounds containing two or more isocyanate groups in one molecule.

Examples of the chain extender include aliphatic, aromatic, heterocyclic, or alicyclic low-molecular-weight polyols having two or more hydroxy groups in one molecule.

Specific examples of the polyurethane-based thermoplastic elastomer fibers include fibers of the thermoplastic polyurethane elastomer disclosed in WO 2011/129433 and obtained by using 1,4-bis(2-hydroxyethoxy)benzene as a chain extender.

Examples of a material of the olefin-based thermoplastic elastomer fibers include ethylene-α-olefin random copolymers and such copolymers further copolymerized with a diene as a second component, specifically those in which an ethylene-propylene random copolymer, an ethylene-1-butene random copolymer, or an EPDM (ethylene-propylene-diene copolymer, containing dicyclopentadiene or ethylidene norbornene as a diene component) is a soft segment and a polyolefin is a hard segment. Examples of trade names of such materials of the olefin-based thermoplastic elastomer fibers include TAFMER (manufactured by Mitsui Chemicals, Inc.), MILASTOMER (manufactured by Mitsui Chemicals, Inc.), EVAFLEX-EEA (manufactured by Dow-Mitsui Polychemicals Co., Ltd.), and VISTAMAXX (manufactured by Exxon Mobil Corporation).

Examples of raw materials of the styrene-based thermoplastic elastomer fibers, the polyester-based thermoplastic elastomer fibers, and the polyamide-based thermoplastic elastomer fibers include those materials disclosed in JP-A No. 2001-179867.

The thermoplastic elastomer fibers have a fiber diameter of preferably 4.0 d (denier) or less, more preferably 3.5 d or less, still more preferably 3.0 d or less.

The thermoplastic elastomer fibers may be long fibers (filament) or short fibers (staples). A cross-sectional shape of the thermoplastic elastomer fibers is not particularly limited, and examples thereof include a circular shape, an elliptical shape, and an irregular shape.

(1.3.2) Mixed-Fiber Nonwoven Fabric

The mixed-fiber nonwoven fabric includes thermoplastic elastomer fibers. The mixed-fiber nonwoven fabric is formed of a mixture of sea-island fibers and thermoplastic elastomer fibers.

A mixed fiber ratio of the sea-island fibers is not particularly limited, and it is preferably from 5% by mass to 95% by mass, more preferably from 25% by mass to 75% by mass, still more preferably from 40% by mass to 60% by mass.

The term "mixed fiber ratio" used herein refers to a ratio of a specific type of fibers contained in a nonwoven fabric obtained by mixing two or more types of fibers, or a mixing ratio of various types of fibers in such a nonwoven fabric. In other words, in a mixed-fiber nonwoven fabric formed of sea-island fibers and thermoplastic elastomer fibers, the "mixed fiber ratio of the sea-island fibers" is {Mass of sea-island fibers÷(Mass of sea-island fibers+Mass of thermoplastic elastomer fibers)}. The "mixed fiber ratio of the thermoplastic elastomer fibers" is {Mass of thermoplastic elastomer fibers÷(Mass of sea-island fibers+Mass of thermoplastic elastomer fibers)}.

From the standpoint of obtaining both satisfactory flexibility and satisfactory tensile strength in the mixed-fiber nonwoven fabric, the basis weight of the mixed-fiber nonwoven fabric is preferably 100 $g/m^2$ or less, more preferably 90 $g/m^2$ or less, still more preferably 80 $g/m^2$ or less.

When the mixed-fiber nonwoven fabric is applied to the below-described sanitary material or the like, the basis weight of the mixed-fiber nonwoven fabric is preferably in a range of from 20 $g/m^2$ to 70 $g/m^2$.

Examples of the thermoplastic elastomer fibers include the same ones as those exemplified above as thermoplastic elastomer fibers that may be contained in the resin layer of the layered nonwoven fabric.

(2) Sanitary Material

The sanitary material of the disclosure includes the spunbonded nonwoven fabric of the disclosure.

The spun-bonded nonwoven fabric of the disclosure is excellent in extensibility. Therefore, the sanitary material of the disclosure is also excellent in extensibility.

The sanitary material can be suitably used in various sanitary material applications where extensibility and flexibility are required. Specifically, the sanitary material can be suitably used in absorbent articles such as disposable diapers and sanitary napkins, and medical sanitary materials such as bandages, medical gauze, and towels, as well as sanitary masks.

(3) Method of Producing Spun-Bonded Nonwoven Fabric

The spun-bonded nonwoven fabric of the disclosure is produced by a conventional method using a thermoplastic resin composition as a raw material.

The spun-bonded nonwoven fabric of the disclosure is produced, for example, in the following manner.

That is, the thermoplastic resin composition is introduced to and melted in an extruder. The resulting melt of the thermoplastic resin composition is spun using a spun-bonded nonwoven fabric forming machine equipped with plural spinnerets. The thus obtained continuous fiber group is stretched while controlling the air volume of a blower or the like. In this process, the continuous fiber group is cooled as required. Thereafter, the continuous fiber group is deposited on a collection surface of the spun-bonded nonwoven fabric forming machine to obtain a spun-bonded web. The thus obtained spun-bonded web is hot-pressed using an embossing roll, whereby the spun-bonded nonwoven fabric is obtained.

The formulation of the thermoplastic resin composition is the same as the one exemplified above for the sea-island fibers.

One example of a method of producing a spun-bonded nonwoven fabric will now be described in detail referring to a drawing.

FIG. 1 is a schematic drawing that illustrates one example of a production apparatus used for a closed-system spunbonding method. In the closed-system spunbonding method, a continuous fiber group obtained by melt-spinning a thermoplastic resin composition is stretched while being cooled in a closed space.

A production apparatus 100 for a closed-system spunbonding method that is illustrated in FIG. 1 is provided with a spinning section 10. The spinning section 10 includes an extruder 11, a spinneret 12, a cooling chamber 13, a cooling air supply unit 14, a cooling air supply unit 15, and a stretching section 16. The extruder 11 extrudes a thermoplastic polymer. The spinneret 12 performs spinning of a melt of the thermoplastic polymer. The cooling chamber 13 cools a continuous fiber group 1 spun from the spinneret 12. The cooling air supply unit 14 and the cooling air supply unit 15 each supply a cooling air A into the cooling chamber 13 and the stretching section 16. The stretching section 16 is where the continuous fiber group 1 is stretched.

First, a thermoplastic resin composition is introduced into the extruder 11. The thermoplastic resin composition introduced into the extruder 11 is melt-kneaded in the extruder 11. The resulting melt of the thermoplastic resin composition is extruded from the extruder 11.

The melt of the thermoplastic resin composition extruded from the extruder 11 is introduced to the spinneret 12. The melt of the thermoplastic resin composition introduced to the spinneret 12 is extruded from the spinneret 12 and thereby spun. By this, the continuous fiber group 1 is formed.

The continuous fiber group 1 is introduced to the cooling chamber 13. The continuous fiber group 1 introduced to the cooling chamber 13 is cooled by the cooling air A. The cooling air A is supplied into the cooling chamber 13 and the stretching section 16 from at least one of the cooling air supply unit 14 or the cooling air supply unit 15. The thus cooled continuous fiber group 1 is introduced to the stretching section 16, which is arranged on the downstream side of the cooling chamber 13.

The stretching section 16 has a bottleneck portion 16*a* and a cylindrical portion 16*b*. The cylindrical portion 16*b* is formed on one end of the bottleneck portion 16*a* on the lower side (i.e. the side of a moving collection member 21) in the vertical direction (i.e. the direction of gravity). The bottleneck portion 16*a* is in the form of a narrow path. The cylindrical portion 16*b* is a cylindrical object. As illustrated in FIG. 1, the hollow part of the cylindrical portion 16*b* expands downward. The continuous fiber group 1 introduced to the stretching section 16 is stretched by an increased speed of the cooling air in the bottleneck portion 16*a*. The continuous fiber group 1 thus stretched and passed through the cylindrical portion 16*b* is dispersed and collected on the moving collection member 21.

The dispersed continuous fiber group 1 is efficiently collected on the moving collection member 21 by means of a suction unit 22. The suction unit 22 is arranged underneath the collection surface of the moving collection member 21. By this, a spun-bonded web 2 is formed.

Thereafter, the fibers contained in the spun-bonded web 2 are hot-pressed by, for example, an embossing roll (not illustrated), and bonded with each other, whereby a spun-bonded nonwoven fabric is obtained.

A method of producing the spun-bonded nonwoven fabric of the disclosure has been described taking a closed-system spunbonding method as an example; however, the method of producing the spun-bonded nonwoven fabric of the disclosure is not limited to a closed-system spunbonding method. The method of producing the spun-bonded nonwoven fabric of the disclosure may be an open-system spunbonding method. In the open-system spunbonding method, a continuous fiber group obtained by melt-spinning a thermoplastic resin composition is cooled.

The temperature at which the thermoplastic resin composition is melted is not particularly limited as long as it is not lower than the softening temperature or melting temperature of the thermoplastic resin composition but is lower than the thermal decomposition temperature of the thermoplastic resin composition, and it is set as appropriate in accordance with the physical properties and the like of the thermoplastic resin composition.

The temperature of the spinneret 12 is adjusted as appropriate in accordance with the physical properties and the like of the thermoplastic resin composition. Taking into consideration the physical properties of the specific polypropylene (A) contained in the thermoplastic resin composition, the temperature of the spinneret 12 is preferably from 180° C. to 240° C., more preferably from 190° C. to 230° C., still more preferably from 200° C. to 225° C.

A pore size of the spinneret 12 is not particularly limited and, from the standpoint of the extensibility of the resulting spun-bonded nonwoven fabric, it is preferably from 0.05 mm to 1.00 mm.

From the standpoint of the extensibility of the resulting spun-bonded nonwoven fabric, the single-pore discharge amount of the melt of the thermoplastic resin composition from the spinneret 12 is preferably from 0.1 g/min to 3.0 g/min, more preferably from 0.3 g/min to 1.0 g/min.

The temperature of the cooling air used for cooling the continuous fiber group extruded from the spinneret is not particularly limited as long as it is a temperature at which the thermoplastic resin composition is solidified. The temperature of the cooling air is preferably from 5° C. to 50° C., more preferably from 10° C. to 40° C., still more preferably from 15° C. to 30° C.

In a method of producing the spun-bonded nonwoven fabric of the disclosure, the fibers contained in the spun-bonded nonwoven fabric may be partially heat-fused. The fibers contained in the spun-bonded nonwoven fabric may also be press-compacted with a nip roll prior to being heat-fused.

EXAMPLES

Embodiments of the disclosure will now be described more concretely by way of Examples; however, the invention is not limited to the below-described Examples that are each an embodiment of the disclosure.

The physical property values and the like of spun-bonded nonwoven fabrics in Examples and Comparative Examples were measured by the following methods.

(1) Basis Weight [g/m$^2$]

From each spun-bonded nonwoven fabric, 10 test pieces of 300 mm in the machine direction (MD) and 250 mm in the cross direction (CD) were collected. The collection was made at 10 arbitrary spots of the spun-bonded nonwoven fabric. Then, the mass (g) of each of the thus collected test pieces was measured using an electronic even balance (manufactured by Kensei Kogyo Co., Ltd.), and an average mass of the test pieces was calculated. The thus calculated average value was converted into the mass (g) per 1 m$^2$ and rounded off to the nearest whole number to determine the basis weight [g/m$^2$] of the spun-bonded woven fabric.

(2) Maximum Elongation, Tensile Strength (Maximum Strength), and Tensile Strength Ratio ($S_{MD}/S_{CD}$)

In accordance with JIS L1906-6.12.1 [Method A] (changed to JIS L1913:2010, corresponding to ISO 9073-3:1989), 5 test pieces of 25 cm in the machine direction (MD) and 5 cm in the cross direction (CD) were collected from each spun-bonded nonwoven fabric in a thermostatic chamber having a temperature of 20±2° C. and a humidity of 65±2% as prescribed in JIS Z8703 (Standard Atmospheric Conditions for Testing). For each of the thus collected test pieces, a tensile test was conducted using a tensile tester (INSTRON 5564, manufactured by Instron Japan Co., Ltd.) at a temperature of 20±2° C., a chuck distance of 100 mm, and a tensile speed of 300 mm/min to measure the tensile load, and an average value of the thus measured maximum tensile load was determined as the tensile strength (maximum strength) [N/50 mm] in the machine direction (MD).

The elongation at this tensile strength (maximum strength) was defined as the maximum elongation [%] and used as an index for evaluating the extensibility. For the measurement of the tensile strength and the maximum elongation in the cross direction, 5 test pieces of 25 cm in the cross direction (CD) and 5 cm in the machine direction (MD) were collected and subjected to a tensile test under the same conditions. Specifically, the maximum elongation [%] in the machine direction is calculated by the following equation:

$$\text{Maximum elongation}[\%]-\{(\text{Maximum length}-25\text{ cm})/25\text{ cm}\}\times 100$$

In this equation, "maximum length" represents the length [cm] of a test piece exhibiting a tensile strength along its long side.

The tensile strength ratio ($S_{MD}/S_{CD}$) was determined from the thus measured values of the tensile strength ($S_{MD}$) in the machine direction (MD) and the tensile strength ($S_{CD}$) in the cross direction (CD).

(3) Fiber Diameter

From each spun-bonded nonwoven fabric, 10 test pieces of 10 mm×10 mm in size were collected, and the fiber diameter was measured to the first decimal place in micrometers under a microscope ECLIPSE E400 manufactured by Nikon Corporation at a magnification of ×20. The diameter was measured at 20 arbitrary spots of each test piece, and an average value thereof was determined.

(4) Confirmation of Sea-Island Structure and Island Phase Ratio (%)

A fiber was removed from each spun-bonded nonwoven fabric and embedded in paraffin to prepare a measurement sample. This measurement sample was placed on a microtome such that its blade was parallel to the direction perpendicular to the axial direction of the fiber, and the measurement sample was sliced along the direction perpendicular to the axial direction of the fiber. Subsequently, the thus sliced fiber was reinforced with carbon, a cross-section of this fiber was observed under a transmission electron microscope (TEM). The sea-island structure was observed at the cross-section of the fiber. Defining a continuous phase as "sea phase" and phases existing in a dispersed manner as "island phases", the diameters of the island phases included in the observed area (cross-section) were measured. The number of island phases having a diameter of 0.32 μm or more and that of island phases having a diameter of less than 0.32 μm were counted. The number of island phases corresponding to each range was divided by the number of island phases in the observed area (cross-section) to calculate a ratio (i.e. island phase ratio).

As the transmission electron microscope, a transmission electron microscope Model H-7650 manufactured by Hitachi High-Tech Science Corporation was employed. The observation magnification was ×6,000.

The diameters of the island phases were determined by image analysis using Mac-View (manufactured by Mountech Co., Ltd.). Specifically, the major axis and the minor axis of each island phase were measured, and an average value thereof was defined as the diameter. The island phase area ratio was defined as a value obtained by dividing a total area of the island phases by a total area of a cross-section of the sea-island fiber.

(5) Evaluation of Spinnability

During spinning of each spun-bonded nonwoven fabrics of Examples, the number of fiber breakages that occurred in a period of 30 minutes (hereinafter, referred to as "number of fiber breakages") was measured. Based on the results of measuring the number of fiber breakages, the spinnability was evaluated by the following criteria. An acceptable evaluation of the spinnability is "A".

A: The number of fiber breakages was 0.
B: The number of fiber breakages was from 1 to 3.
C: The number of fiber breakages was 4 or more.

Example 1

<Production of Spun-Bonded Nonwoven Fabric>

A mixture of the following materials was melted using a 75-mmφ extruder:

92.7 parts by mass of a propylene homopolymer (1) having an MFR (measured in accordance with ASTM D1238 at a temperature of 230° C. and a load of 2.16 kg) of 60 g/10 min, a density of 0.91 g/cm$^3$, and a melting point of 160° C.;

6.0 parts by mass of a high-density polyethylene having an MFR (measured in accordance with ASTM D1238 at a temperature of 190° C. and a load of 2.16 kg) of 5 g/10 min, a density of 0.95 g/cm$^3$, and a melting point of 134° C. (hereinafter, referred to as "polyethylene");

1.0 parts by mass of an ethylene-propylene copolymer wax [manufactured by Mitsui Chemicals, Inc., product name "Hi-WAX (registered trademark) 320P", density: 0.93 g/cm$^3$, weight-average molecular weight: 3,000]; and 0.3 parts by mass of erucic acid amide.

This mixture was melt-spun by a spunbonding method using a spun-bonded nonwoven fabric forming machine equipped with a 1,093-hole spinneret (length in direction perpendicular to machine flow direction on collection surface: 320 mm, see FIG. 1) under the conditions in which the resin temperature and the die temperature were both 200° C., the resin discharge amount was 32 kg/h, the cooling air temperature was 20° C., and the stretching air flow rate was 3,529 m/min, and the resultant was deposited on the collection surface and then hot-pressed using an embossing roll (embossed area ratio (hot-press rate))=18%, embossing temperature=90° C.), whereby a spun-bonded nonwoven fabric having a total basis weight of 18.0 g/m$^2$ was produced. The number of fiber breakages during the test was 0.

Figure 2:
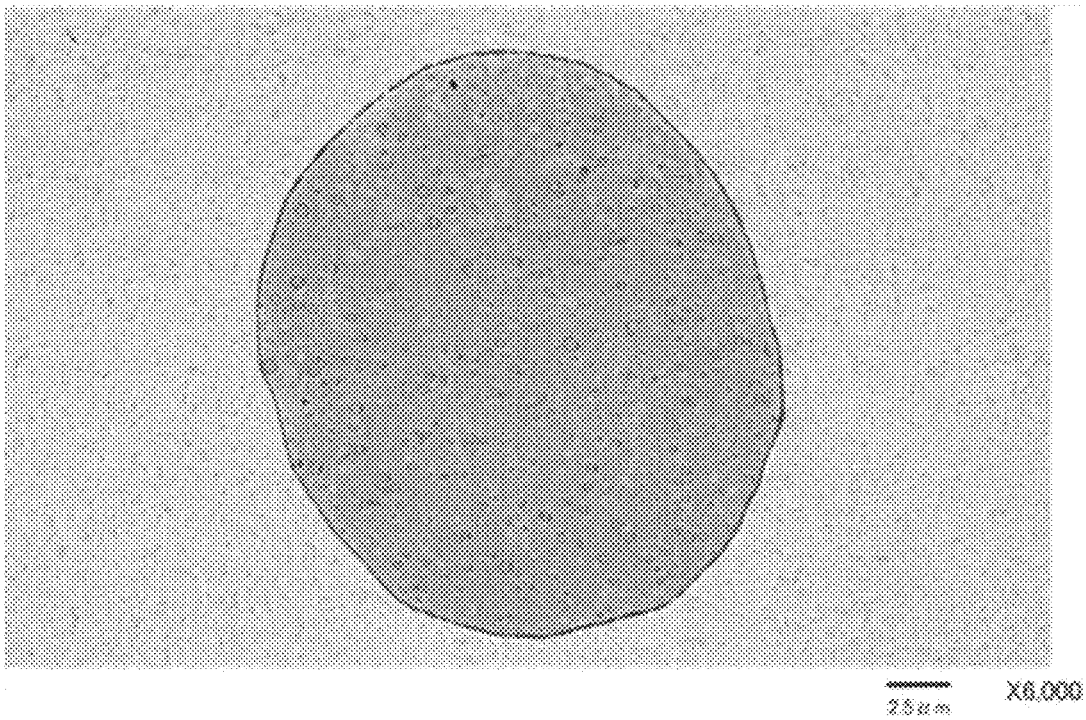
FIG. 2 is a transmission electron micrograph (magnification: ×6,000) of a cross-section of a fiber contained in the spun-bonded nonwoven fabric of Example 1.

FIG. 2 shows an image that was taken in the observation of a cross-section of a fiber contained in the spun-bonded nonwoven fabric obtained in Example 1 under a transmission electron microscope.

Example 2

A spun-bonded nonwoven fabric was produced and evaluated in the same manner as in Example 1, except that the amount of the propylene homopolymer (1) having a melting point of 160° C. and the amount of "Hi-WAX (product name, registered trademark) 320P" [density: 0.93 g/cm$^3$, weight-average molecular weight: 3,000] were changed to 91.7 parts by mass and 2.0 parts by mass, respectively. The number of fiber breakages during the test was 0.

Example 3

A spun-bonded nonwoven fabric was produced and evaluated in the same manner as in Example 1, except that the amount of the propylene homopolymer (1) having a melting point of 160° C. and the amount of "Hi-WAX (product name, registered trademark) 320P" [density: 0.93 g/cm$^3$, weight-average molecular weight: 3,000] were changed to 90.7 parts by mass and 3.0 parts by mass, respectively. The number of fiber breakages during the test was 0.

Example 4

A spun-bonded nonwoven fabric was produced and evaluated in the same manner as in Example 1, except that the amount of the propylene homopolymer (1) having a melting point of 160° C., the amount of the polyethylene, and the amount of "Hi-WAX (product name, registered trademark) 320P" [density: 0.93 g/cm$^3$, weight-average molecular weight: 3,000] were changed to 87.7 parts by mass, 10.0 parts by mass, and 2.0 parts by mass, respectively. The number of fiber breakages during the test was 0.

Example 5

A spun-bonded nonwoven fabric was produced and evaluated in the same manner as in Example 4, except that the amount of the propylene homopolymer (1) having a melting point of 160° C. and the amount of "Hi-WAX (product name, registered trademark) 320P" [density: 0.93 g/cm$^3$, weight-average molecular weight: 3,000] were changed to 86.7 parts by mass and 3.0 parts by mass, respectively. The number of fiber breakages during the test was 0.

Example 6

A spun-bonded nonwoven fabric was produced and evaluated in the same manner as in Example 1, except that "Hi-WAX (product name, registered trademark) 320P" [density: 0.93 g/cm$^3$, weight-average molecular weight: 3,000] was changed to an ethylene-butene copolymer wax [manufactured by Mitsui Chemicals, Inc., product name "EXCEREX (registered trademark) 30200B", density: 0.92 g/cm$^3$, weight-average molecular weight: 2,900]. The number of fiber breakages during the test was 0.

Example 7

A spun-bonded nonwoven fabric was produced and evaluated in the same manner as in Example 1, except that "Hi-WAX (product name, registered trademark) 320P" [density: 0.93 g/cm$^3$, weight-average molecular weight: 3,000] was changed to an ethylene polymer wax [manufactured by Mitsui Chemicals, Inc., product name "Hi-WAX (registered trademark) 100P", density: 0.95 g/cm$^3$, weight-average molecular weight: 900]. The number of fiber breakages during the test was 0.

Example 8

A spun-bonded nonwoven fabric was produced and evaluated in the same manner as in Example 1, except that "Hi-WAX (product name, registered trademark) 320P" [density: 0.93 g/cm$^3$, weight-average molecular weight: 3,000] was changed to an ethylene-propylene copolymer wax [manufactured by Mitsui Chemicals, Inc., product name "Hi-WAX (registered trademark) 110P", density: 0.92 g/cm$^3$, weight-average molecular weight: 1,000]. The number of fiber breakages during the test was 0.

Example 9

A spun-bonded nonwoven fabric was produced and evaluated in the same manner as in Example 8, except that the amount of the propylene homopolymer (1) having a melting point of 160° C. and the amount of the polyethylene were changed to 93.7 parts by mass and 5.0 parts by mass, respectively. The number of fiber breakages during the test was 0.

Example 10

A spun-bonded nonwoven fabric was produced and evaluated in the same manner as in Example 8, except that the amount of the propylene homopolymer (1) having a melting point of 160° C. and the amount of the polyethylene were changed to 94.7 parts by mass and 4.0 parts by mass, respectively. The number of fiber breakages during the test was 0.

Example 11

A spun-bonded nonwoven fabric was produced and evaluated in the same manner as in Example 10, except that the amount of the propylene homopolymer (1) having a melting point of 160° C. and the amount of the polyethylene were changed to 93.0 parts by mass and 6.0 parts by mass, respectively, and erucic acid amide was not used. The number of fiber breakages during the test was 0.

Comparative Example 1

A mixture of the following materials was melted using a 75-mmφ extruder:

92.7 parts by mass of a propylene homopolymer (1) having an MFR (measured in accordance with ASTM D1238 at a temperature of 230° C. and a load of 2.16 kg) of 60 g/10 min, a density of 0.91 g/cm$^3$, and a melting point of 160° C.;

6 parts by mass of a high-density polyethylene having an MFR (measured in accordance with ASTM D1238 at a temperature of 190° C. and a load of 2.16 kg) of 5 g/10 min, a density of 0.95 g/cm$^3$, and a melting point of 134° C. (hereinafter, referred to as "polyethylene"); and 0.3 parts by mass of erucic acid amide.

This mixture was melt-spun by a spunbonding method using a spun-bonded nonwoven fabric forming machine equipped with a 1,093-hole spinneret (length in direction perpendicular to machine flow direction on collection surface: 320 mm, see FIG. 1) under the conditions in which the resin temperature and the die temperature were both 200° C., the resin discharge amount was 32 kg/h, the cooling air temperature was 20° C., and the stretching air flow rate was 3,529 m/min, and the resultant was deposited on the collection surface and then hot-pressed using an embossing roll (embossed area ratio (hot-press rate))=18%, embossing temperature=90° C.), whereby a spun-bonded nonwoven fabric having a total basis weight of 18.0 g/m$^2$ was produced. The number of fiber breakages during the test was 1.

Figure 3:
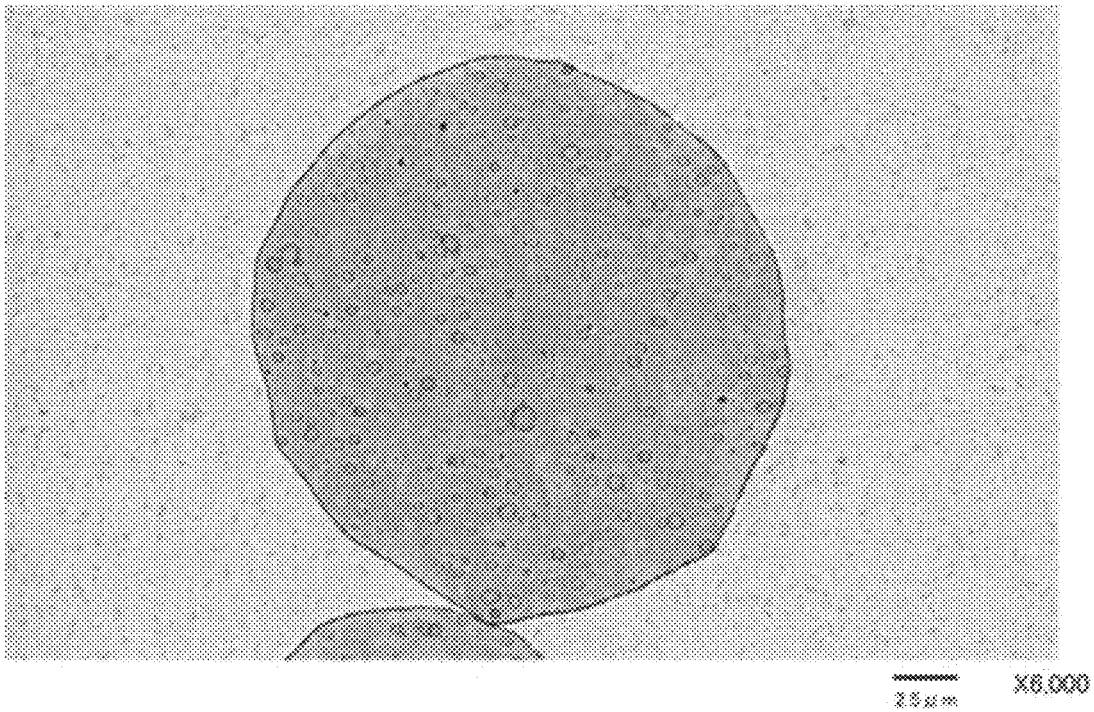
FIG. 3 is a transmission electron micrograph (magnification: ×6,000) of a cross-section of a fiber contained in the spun-bonded nonwoven fabric of Comparative Example 1.

FIG. 3 shows an image that was taken in the observation of a cross-section of a fiber contained in the spun-bonded nonwoven fabric obtained in Comparative Example 1 under a transmission electron microscope.

Comparative Example 2

A spun-bonded nonwoven fabric was produced and evaluated in the same manner as in Example 8, except that the shape of the stretching section was adjusted such that fibers were dispersed in the cross direction (CD) (specifically, the vertical length L of the cylindrical portion 16*b* of the stretching section 16 (see FIG. 1) was increased by 50 times. The number of fiber breakages during the test was 0.

It is noted here that, in Comparative Example 2, the cylindrical portion 16*b* was in contact with neither the moving collection member 21 nor the spun-bonded web 2 formed on the moving collection member 21.

Comparative Example 3

A spun-bonded nonwoven fabric was produced and evaluated in the same manner as in Example 1, except that "Hi-WAX (product name, registered trademark) 320P" was changed to a low-crystalline polypropylene homopolymer [manufactured by Idemitsu Kosan Co., Ltd., product name "S400", density: 0.87 g/cm$^3$, weight-average molecular weight: 45,000]. The number of fiber breakages during the test was 0.

Comparative Example 4

A spun-bonded nonwoven fabric was produced and evaluated in the same manner as in Example 1, except that the amount of the propylene homopolymer (1) having a melting point of 160° C., the amount of the polyethylene, and the amount of "Hi-WAX (product name, registered trademark) 320P" were changed to 83.7 parts by mass, 14.0 parts by mass, and 2.0 parts by mass, respectively. The number of fiber breakages during the test was 0.

TABLE 1

| | | | | | Examples | | | | | | | |
|---|---|---|---|---|---|---|---|---|---|---|---|---|
| | | | | | 1 | 2 | 3 | 4 | 5 | 6 | 7 | 8 |
| Resin composition (% by mass) | | Propylene homopolymer | | | 92.7 | 91.7 | 90.7 | 87.7 | 86.7 | 92.7 | 92.7 | 92.7 |
| | | Polyethylene | | | 6.0 | 6.0 | 6.0 | 10.0 | 10.0 | 6.0 | 6.0 | 6.0 |
| | | Low-molecular-weight olefin polymer | 320P | | 1.0 | 2.0 | 3.0 | 2.0 | 3.0 | — | — | — |
| | | | 30200B | | — | — | — | — | — | 1.0 | — | — |
| | | | 100P | | — | — | — | — | — | — | 1.0 | — |
| | | | 110P | | — | — | — | — | — | — | — | 1.0 |
| | | Low-crystalline PP homopolymer | S400 | | — | — | — | — | — | — | — | — |
| | | Fatty acid amide | Erucic acid amide | | 0.3 | 0.3 | 0.3 | 0.3 | 0.3 | 0.3 | 0.3 | 0.3 |
| Evaluation results | | Spinnability | | | A | A | A | A | A | A | A | A |
| | Spun-bonded nonwoven fabric | Basis weight | | [g/m$^2$] | 18 | 18 | 18 | 18 | 18 | 18 | 18 | 18 |
| | | Tensile strength | $S_{MD}$ | [N/50 mm] | 38 | 35 | 36 | 38 | 33 | 37 | 39 | 43 |
| | | | $S_{CD}$ | [N/50 mm] | 10.2 | 10.6 | 11.1 | 8.6 | 10.3 | 8.6 | 8.5 | 8.6 |
| | | Maximum elongation | MD | [%] | 227 | 246 | 252 | 222 | 214 | 222 | 227 | 249 |
| | | | CD | [%] | 152 | 156 | 172 | 94 | 134 | 119 | 146 | 151 |
| | | Tensile strength ratio ($S_{MD}/S_{CD}$) | | [—] | 3.8 | 3.3 | 3.2 | 4.4 | 3.2 | 4.4 | 4.6 | 5.0 |
| | | Fiber diameter | | [d] | 2.8 | 2.8 | 2.8 | 2.6 | 2.6 | 2.6 | 2.6 | 2.6 |
| | | Island phase ratio | ≥0.32 m | [%] | 24.7 | 4.2 | 0.5 | 9.8 | 4.2 | 1.0 | 37.4 | 36.0 |
| | | | <0.32 μm | | 75.3 | 95.8 | 99.5 | 90.2 | 95.8 | 99.0 | 62.6 | 64.0 |

TABLE 1-continued

| | | | | | Examples | | | Comparative Examples | | | |
|---|---|---|---|---|---|---|---|---|---|---|---|
| | | | | | 9 | 10 | 11 | 1 | 2 | 3 | 4 |
| Resin composition (% by mass) | | Propylene homopolymer | | | 93.7 | 94.7 | 93.0 | 93.7 | 92.7 | 92.7 | 83.7 |
| | | Polyethylene | | | 5.0 | 4.0 | 6.0 | 6.0 | 6.0 | 6.0 | 14.0 |
| | | Low-molecular-weight olefin polymer | 320P | | — | — | — | — | — | — | 2.0 |
| | | | 30200B | | — | — | — | — | — | — | — |
| | | | 100P | | — | — | — | — | — | — | — |
| | | | 110P | | 1.0 | 1.0 | 1.0 | — | 1.0 | — | — |
| | | Low-crystalline PP homopolymer | S400 | | — | — | — | — | — | 1.0 | — |
| | | Fatty acid amide | Erucic acid amide | | 0.3 | 0.3 | — | 0.3 | 0.3 | 0.3 | 0.3 |
| Evaluation results | | Spinnability | | | A | A | A | B | A | A | A |
| | Spun-bonded nonwoven fabric | Basis weight | | [g/m$^2$] | 18 | 18 | 18 | 18 | 18 | 18 | 18 |
| | | Tensile strength | $S_{MD}$ | [N/50 mm] | 34 | 40 | 46 | 38 | 36 | 35 | 36 |
| | | | $S_{CD}$ | [N/50 mm] | 8.0 | 8.1 | 9.4 | 8.6 | 21 | 9.6 | 6.9 |
| | | Maximum elongation | MD | [%] | 225 | 206 | 254 | 195 | 127 | 197 | 159 |
| | | | CD | [%] | 122 | 118 | 161 | 118 | 110 | 130 | 70 |
| | | Tensile strength ratio ($S_{MD}/S_{CD}$) | | [—] | 4.2 | 4.9 | 4.8 | 4.4 | 1.7 | 3.7 | 5.2 |
| | | Fiber diameter | | [d] | 2.9 | 2.8 | 2.8 | 2.8 | 2.2 | 2.6 | 2.5 |
| | | Island phase ratio | ≥0.32 m | [%] | 4.4 | 7.8 | 30.5 | 41.4 | 0.2 | 46.2 | — |
| | | | <0.32 μm | | 95.6 | 92.2 | 69.5 | 58.6 | 99.8 | 53.8 | — |

In Table 1, "Low-crystalline PP homopolymer" indicates a low-crystalline polypropylene homopolymer.

As shown in Table 1, the spun-bonded nonwoven fabrics of Examples 1 to 11 each contained sea-island fibers formed of a resin composition containing a propylene homopolymer and a polyethylene. It was confirmed that the sea-island fibers all had a sea-island structure. The sea-island fibers included fibers having an island phase ratio of 60% or higher on a number basis. The spun-bonded nonwoven fabrics of Examples 1 to 11 had a tensile strength ratio ($S_{MD}/S_{CD}$) of from 2.0 to 5.0. Therefore, the spun-bonded nonwoven fabrics of Examples 1 to 11 were evaluated as "A" in terms of spinnability, and had a maximum elongation of more than 197% in the machine direction (MD). As a result, the spun-bonded nonwoven fabrics of Examples 1 to 11 were found to be excellent in both extensibility and spinnability. From these evaluation results, it was found that the spun-bonded nonwoven fabric of the disclosure has excellent productivity and is suitable for sanitary material applications where various secondary processing properties are required.

On the other hand, the spun-bonded nonwoven fabrics of Comparative Examples 1 and 3 each contained sea-island fibers formed of a resin composition containing a propylene homopolymer and a polyethylene. It was confirmed that the sea-island fibers all had a sea-island structure. The sea-island fibers, however, did not include fibers having an island phase ratio of 60% or higher on a number basis. Therefore, the spun-bonded nonwoven fabrics of Comparative Examples 1 and 3 had a maximum elongation of 197% or less in the machine direction (MD). Further, the spun-bonded nonwoven fabric of Comparative Example 1 was evaluated as "B" in terms of spinnability. As a result, the spun-bonded nonwoven fabrics of Comparative Examples 1 and 3 were found to be not excellent in extensibility and spinnability.

The spun-bonded nonwoven fabrics of Comparative Examples 2 and 4 each contained sea-island fibers formed of a resin composition containing a propylene homopolymer and a polyethylene. The tensile strength ratios ($S_{MD}/S_{CD}$) of the spun-bonded nonwoven fabrics of Comparative Examples 2 and 4 were not in a range of from 2.0 to 5.0. Therefore, the spun-bonded nonwoven fabrics of Comparative Examples 2 and 4 had a maximum elongation of less than 197% in the machine direction (MD). As a result, the spun-bonded nonwoven fabrics of Comparative Examples 2 and 4 were found to be not excellent in extensibility and spinnability.

The disclosure of Japanese Patent Application No. 2021-058789 filed on Mar. 30, 2021 is hereby incorporated by reference in its entirety.

All the documents, patent applications, and technical standards that are described in the present specification are hereby incorporated by reference to the same extent as if each individual document, patent application, or technical standard is concretely and individually described to be incorporated by reference.

The invention claimed is:

1. A spun-bonded nonwoven fabric, comprising fibers formed of a resin composition that comprises:

a propylene polymer (A);

a polymer (B) which is at least one selected from the group consisting of polyolefins, other than the propylene polymer (A), and polyesters; and a low-molecular-weight olefin polymer having a weight-average molecular weight of from 500 to 30,000, wherein:

the fibers have a sea-island structure, the fibers comprise fibers in which a ratio of island phases having a diameter of less than 0.32 μm among island phases at a cross-section perpendicular to an axial direction of the fibers is 60% or higher on a number basis, a ratio ($S_{MD}/S_{CD}$) of a tensile strength ($S_{MD}$) in a machine flow direction (MD) with respect to a tensile strength ($S_{CD}$) in a direction (CD) perpendicular to the machine flow direction (MD) is from 2.0 to 5.1, a content of the low-molecular-weight olefin polymer is from 1.0% by mass to 5.0% by mass with respect to a total amount of the resin composition, a sea phase contained in the sea-island structure comprises the propylene polymer (A), and the island phases comprise the polymer (B).

2. The spun-bonded nonwoven fabric according to claim 1, wherein the propylene polymer (A) comprises a propylene homopolymer.

3. The spun-bonded nonwoven fabric according to claim 1, wherein the polymer (B) comprises a homopolymer of an α-olefin having from 2 to 8 carbon atoms, other than the propylene polymer (A).

4. The spun-bonded nonwoven fabric according to claim 1, wherein the polymer (B) comprises a polyethylene.

5. The spun-bonded nonwoven fabric according to claim 4, wherein the polyethylene has a density of from 0.94 g/cm$^3$ to 0.97 g/cm$^3$.

6. The spun-bonded nonwoven fabric according to claim 1, wherein the ratio ($S_{MD}/S_{CD}$) is from 2.5 to 5.1.

7. The spun-bonded nonwoven fabric according to claim 1, wherein a content of the propylene polymer (A) is from 85.0% by mass to 95.0% by mass with respect to a total amount of the resin composition.

8. The spun-bonded nonwoven fabric according to claim 1, wherein a content of the polymer (B) is from 1.0% by mass to 10.0% by mass with respect to a total amount of the resin composition.

9. The spun-bonded nonwoven fabric according to claim 1, wherein:

the spun-bonded nonwoven fabric comprises thermoplastic elastomer fibers and is a layered nonwoven fabric or a mixed-fiber nonwoven fabric, the layered nonwoven fabric comprises a spun-bonded web comprising the fibers, and a resin layer that is disposed on at least one main surface of the spun-bonded web and comprises the thermoplastic elastomer fibers, the spun-bonded web and the resin layer being bonded with each other, and the mixed-fiber nonwoven fabric comprises a mixture of the fibers and the thermoplastic elastomer fibers.

10. The spun-bonded nonwoven fabric according to claim 9, wherein the thermoplastic elastomer fibers are polyurethane-based thermoplastic elastomer fibers, or olefin-based thermoplastic elastomer fibers.

11. A sanitary material, comprising the spun-bonded nonwoven fabric according to claim 1.

* * * * *